US011709444B2

(12) United States Patent
Uekawa

(10) Patent No.: US 11,709,444 B2
(45) Date of Patent: Jul. 25, 2023

(54) IMAGE HEATING APPARATUS, IMAGE FORMING APPARATUS, AND HEATER

(71) Applicant: Canon Kabushiki Kaisha, Tokyo (JP)

(72) Inventor: Eiji Uekawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/568,000

(22) Filed: Jan. 4, 2022

(65) Prior Publication Data

US 2022/0197199 A1 Jun. 23, 2022

Related U.S. Application Data

(63) Continuation of application No. 17/177,580, filed on Feb. 17, 2021, now Pat. No. 11,249,426.

(30) Foreign Application Priority Data

Feb. 18, 2020 (JP) ..... 2020-025318

(51) Int. Cl.
*G03G 15/20* (2006.01)

(52) U.S. Cl.
CPC ..... *G03G 15/2039* (2013.01); *G03G 15/2064* (2013.01)

(58) Field of Classification Search
CPC ..... G03G 15/2039
See application file for complete search history.

(56) References Cited

U.S. PATENT DOCUMENTS 6,043,832 A 3/2000 Harada et al.
10,649,377 B2 5/2020 Ogura et al.
10,983,463 B2 4/2021 Shimura et al.
(Continued)

FOREIGN PATENT DOCUMENTS

CN 107765519 A 3/2018
EP 2136267 A1 12/2009
(Continued)

OTHER PUBLICATIONS

Extended European Search Report dated Jul. 27, 2021 in counterpart European Patent Appln. No. 21157539.4.
(Continued)

*Primary Examiner* — Sevan A Aydin
(74) *Attorney, Agent, or Firm* — Venable LLP

(57) ABSTRACT

An image heating apparatus includes a heater having a first heating block and a second heating block, a heating rotating member to be heated by the heater, a pressure rotating member forming a nip portion for conveying a recording material between the pressure rotating member and the heating rotating member, first temperature detection elements and second temperature detection elements for detecting temperatures of the first heating block and second heating block respectively at positions farther from a recording material conveyance reference position than the first temperature detection elements. In the image heating apparatus, the first temperature detection elements are arranged on a side downstream of the heater in a recording material conveying direction, and the second temperature detection elements are arranged on upstream of the first temperature detection elements in the recording material conveying direction.

3 Claims, 12 Drawing Sheets

(56) References Cited

U.S. PATENT DOCUMENTS

| | | | | |
|---|---|---|---|---|
| 2005/0180789 | A1 | 8/2005 | Nakamura et al. | |
| 2013/0108287 | A1 | 5/2013 | Hayase et al. | |
| 2017/0255141 | A1* | 9/2017 | Kimura | G03G 15/2021 |
| 2017/0269521 | A1 | 9/2017 | Takeda | |
| 2017/0363999 | A1 | 12/2017 | Miyauchi et al. | |
| 2018/0335731 | A1 | 11/2018 | Ogura | |
| 2020/0192260 | A1 | 6/2020 | Suzuki et al. | |
| 2021/0255570 | A1 | 8/2021 | Tsuchihashi et al. | |

FOREIGN PATENT DOCUMENTS

| | | | |
|---|---|---|---|
| EP | 3404491 | A1 | 11/2018 |
| JP | 11-133800 | A | 5/1999 |
| JP | H11-133801 | A | 5/1999 |
| JP | 2003-302865 | A | 10/2003 |
| JP | 2006-317506 | A | 11/2006 |
| JP | 2010-164725 | A | 7/2010 |
| JP | 2011-191453 | A | 9/2011 |
| JP | 2011-191502 | A | 9/2011 |
| JP | 2017054071 | A | 3/2017 |
| JP | 2018105986 | A | 7/2018 |
| JP | 2018194682 | A | 12/2018 |
| JP | 2019023680 | A | 2/2019 |
| JP | 2019032356 | A | 2/2019 |

OTHER PUBLICATIONS

Chinese Notice of Allowance issued in corresponding Chinese Application No. 202110189843.0 dated May 24, 2023.

* cited by examiner

FIG.3A
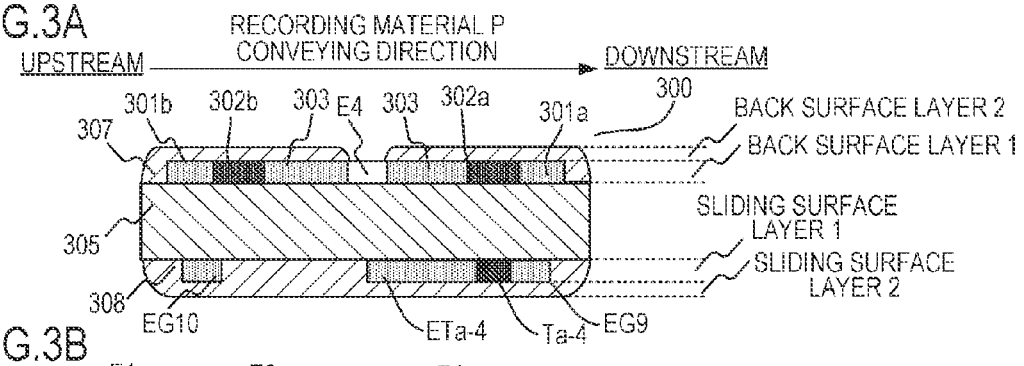
FIG.3B
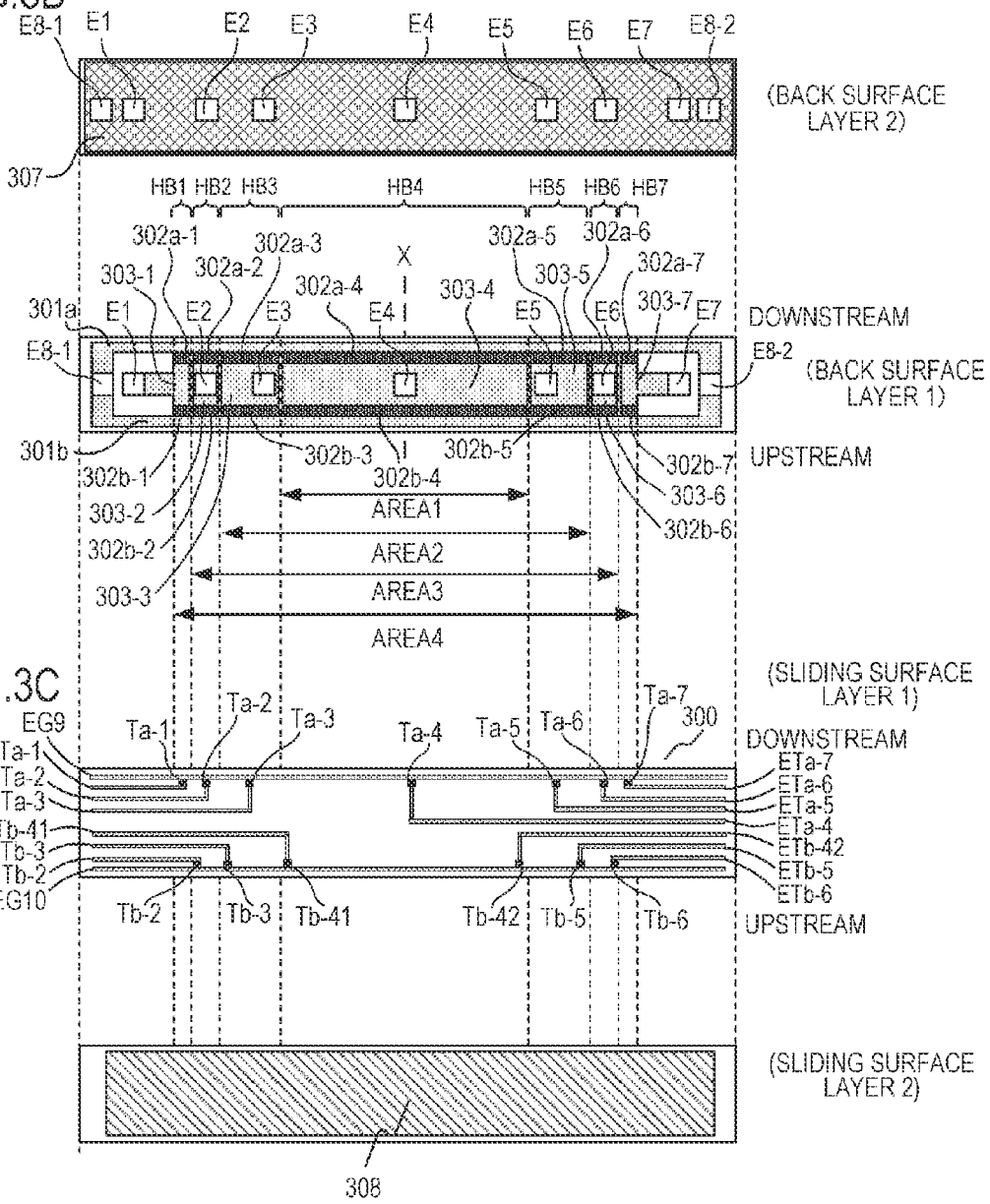
FIG.3C

IMAGE HEATING APPARATUS, IMAGE FORMING APPARATUS, AND HEATER

CROSS-REFERENCE TO RELATED APPLICATIONS

This application is a Continuation of U.S. patent application Ser. No. 17/177,580, filed Feb. 17, 2021, which claims priority to Japanese Patent Application No. 2020-025318, filed Feb. 18, 2020, the entire disclosures of which are both hereby incorporated by reference herein.

BACKGROUND OF THE INVENTION

Field of the Invention

The present invention relates to a fixing unit to be mounted on an image forming apparatus of an electronic photographic recording system such as a copier or a printer, or an image heating apparatus such as a gloss imparting device for improving the glossiness of an image by heating again a fixed toner image on a recording material, and a heating heater equipped in the image heating apparatus.

Description of the Related Art

Conventionally, an image heating apparatus to be mounted on an image forming apparatus such as a copier or a printer includes a device having a cylindrical film, and a pressure roller constituting a fixing member with a heater in contact with the inner surface of the film and forming a nip portion together with the heater via the film. When small-size paper sheets are continuously printed as recording materials in an image forming apparatus installed therein with the image heating apparatus, a phenomenon is caused in which the temperature of a region, through which paper sheets do not pass in the nip portion longitudinal direction, gradually increases (non paper passing portion temperature rising).

As one of the methods for inhibiting this non paper passing portion temperature rising, a device is proposed in which the heating resistor on the theater is divided into a plurality of heating blocks in the heater longitudinal direction, and switching is performed among the heating blocks of the heater according to the size of the recording material (Japanese Patent Application Publication No. 2017-54071). Such a heater is hereinafter referred to as a longitudinal division heater.

Further, an example is proposed in which a plurality of thermistors (temperature detection elements) are arranged at each heating block of the longitudinal division heater (Japanese Patent Application Publication No. 2018-194682). With a plurality of thermistors being arranged at each heating block, even when one of the thermistors becomes incapable of detecting temperature due to disconnection or the like, the other thermistors can detect the failure such as abnormal heating, and can stop electric power supply. Further, there is a merit in that non paper passing portion temperature rising, which is caused when a recording material having a size not matching the division position of the heating block has passed, can be detected.

SUMMARY OF THE INVENTION

Incidentally, the nip portion, formed by pressing contact between a fixing film as a heating rotating member and a pressure roller as a pressure rotating member, elicits neither uniform distribution of the surface pressure by the pressing force nor uniform temperature distribution in the recording material conveying direction. Therefore, in order to optimally perform the temperature control of the heating fixing unit, it is important to arrange the thermistors as temperature detection elements at appropriate positions so as to prevent image defect and abnormal heating. In the arrangement method disclosed in Japanese Patent Application Publication No. 2018-194682, the temperature adjusting thermistor for performing the temperature control of each heating block is arranged on the nip upstream side. With such arrangement, the temperature on the nip downstream side, which becomes hotter, may not be detected and appropriate temperature control may not be performed. As a result, image defects such as poor fixing and hot offset may be caused.

It is an object of the present invention to provide a technology capable of detecting a temperature at a nip portion with more precision, and enabling optimum temperature control.

In order to attain the object, the image heating apparatus of the present invention includes the following:

a heater having a first heating block and a second heating block, the first heating block and the second heating block are aligned in a longitudinal direction of the heater, and the first heating block is independently controlled with respect to the second heating block;

a heating rotating member to be heated by the heater;

a pressure rotating member forming a nip portion for conveying a recording material between the pressure rotating member and the heating rotating member;

first temperature detection elements for detecting a temperature of the first heating block and a temperature of the second heating block, respectively; and second temperature detection elements for detecting a temperature of the first heating block at a position farther from a recording material conveyance reference position than the first temperature detection element corresponding to the first heating block in the longitudinal direction of the heater and a temperature of the second heating block at a position farther from the recording material conveyance reference position than the first temperature detection element corresponding to the second heating block in the longitudinal direction of the heater, respectively, wherein the image heating apparatus heats an image formed on the recording material by using heat of the heater, and wherein the first temperature detection elements for each of the first heating block and the second heating block are arranged on a side downstream of the heater in a recording material conveying direction, and the second temperature detection elements for each of the first heating block and the second heating block are arranged on a side upstream of the first temperature detection elements in the recording material conveying direction.

Further, in order to attain the object, the image forming apparatus of the present invention includes the following:

an image forming portion forming an image on a recording material; and a fixing portion fixing an image, which is formed on the recording material, on the recording material, wherein the fixing portion is the image heating apparatus of the present invention.

Further, in order to attain the object, the heater for use in heating of the image formed on the recording material to be conveyed at the nip portion formed between the heating rotating member and the pressure rotating member in the image heating apparatus of the present invention includes the following:

a substrate;

a first heating block and a second heating block provided on the substrate so as to be aligned in a longitudinal direction of the substrate, and the first heating block is independently controlled with respect to the second heating block;

first temperature detection elements for detecting a temperature of the first heating block and a temperature of the second heating block, respectively; and second temperature detection elements for detecting a temperature of the first heating block at a position farther from a recording material conveyance reference position than the first temperature detection element corresponding to the first heating block in the longitudinal direction of the heater and a temperature of the second heating block at a position farther from the recording material conveyance reference position than the first temperature detection element corresponding to the second heating block in the longitudinal direction of the heater, respectively, wherein the first temperature detection elements for each of the first heating block and the second heating block are arranged on a side downstream of the substrate in a recording material conveying direction, and the second temperature detection elements for each of the first heating block and the second heating block are arranged on a side upstream of the first temperature detection elements in the recording material conveying direction on the substrate.

In accordance with the present invention, it is possible to detect a temperature at a nip portion with more precision and enable more optimum temperature control.

Further features of the present invention will become apparent from the following description of exemplary embodiments with reference to the attached drawings.

BRIEF DESCRIPTION OF THE DRAWINGS

FIGS. 3A to 3C are heater block views of Embodiment 1;

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

(1) Image Forming Apparatus Example

Figure 1:
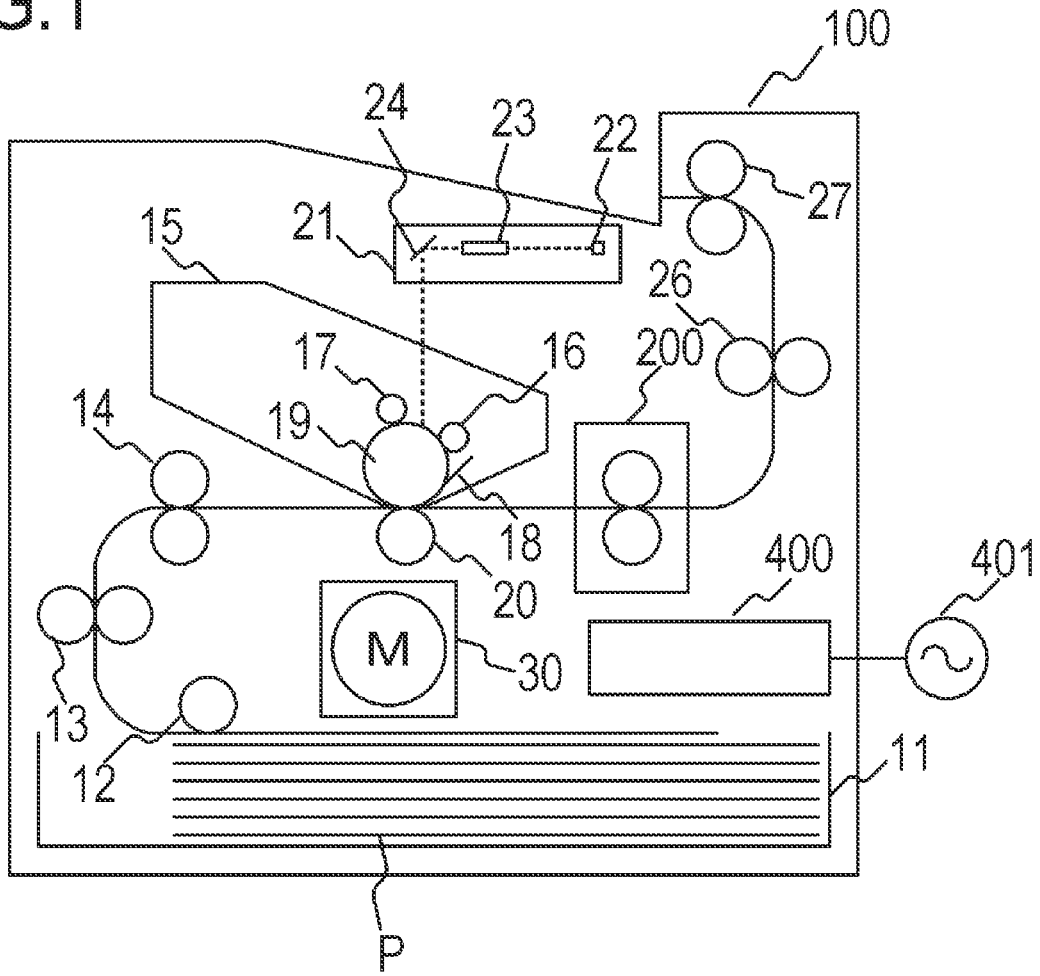
FIG. 1 is a cross sectional view of an image forming apparatus of Embodiment 1.

FIG. 1 is a cross sectional view of an image forming apparatus 100 using the electronic photographic recording technology in accordance with Embodiment 1. As an image forming apparatus to which the present invention is applicable, mention may be made of a printer or a copier using an electrophotographic system or an electrostatic recording system, or the like. Herein, a description will be given to the case where the present invention is applied to a laser printer. When a print signal is generated, a laser light modulated according to the image information is emitted by a scanner unit 21, and it scans a photosensitive member (photosensitive drum) 19 charged to a prescribed polarity by a charging roller 16. As a result, an electrostatic latent image is formed at the photosensitive member 19. A toner is supplied to the electrostatic latent image from a developing device (developing roller) 17, and a toner image corresponding to image information is formed on the photosensitive member 19.

On the other hand, recording materials (recording paper sheets) P stacked on a paper feed cassette 11 are fed one by one by a pickup roller 12, and are conveyed toward a resist roller 14 by a roller 13. Further, the recording material P is conveyed to a transfer position from the resist roller 14 in accordance with the timing at which the toner image on the photosensitive member 19 reaches the transfer position formed by the photosensitive member 19 and a transfer roller 20. In the process in which the recording material P passes through the transfer position, the toner image on the photosensitive member 19 is transferred to the recording material P. Subsequently, the recording material P is heated using the heat of the heater at a fixing apparatus 200 as a fixing portion (image heating portion), so that the toner image is thermally fixed on the recording material P. The recording material P bearing the fixed toner image thereon is discharged to the tray at the top of the image forming apparatus 100 by rollers 26 and 27.

Incidentally, a cleaner 18 cleans the toner left on the photosensitive member 19. The image forming apparatus 100 has a motor 30 for driving the fixing apparatus 200, and the like at the apparatus main body. The fixing apparatus 200 receives power supply from a control circuit 400 as a control means connected to a commercially available AC power supply 401. The photosensitive member 19, the charging roller 16, the scanner unit 21, the developing device 17, and the transfer roller 20 form an image forming portion for forming an unfixed image on a recording material P. Further, in the present Embodiment, the charging roller 16, a developing unit including the developing device 17, the photosensitive member 19, and a cleaning unit including a drum cleaner 18 are configured detachably with respect to the apparatus main body of the image forming apparatus 100 as a process cartridge 15. Further, the scanner unit 21 includes a light source 22, a polygon mirror 23, and a reflection mirror 24.

Further, the image forming apparatus was described by taking a monochrome laser printer using a single-color monochrome toner as a typical example, which is not exclusive. The image forming apparatus is also applicable to a color laser printer of a tandem system of transferring color toners of at least two colors onto a recording material through an intermediate transfer belt, and forming an image thereon, or of other systems.

(2) Fixing Apparatus (Fixing Portion) Example

Figure 2:
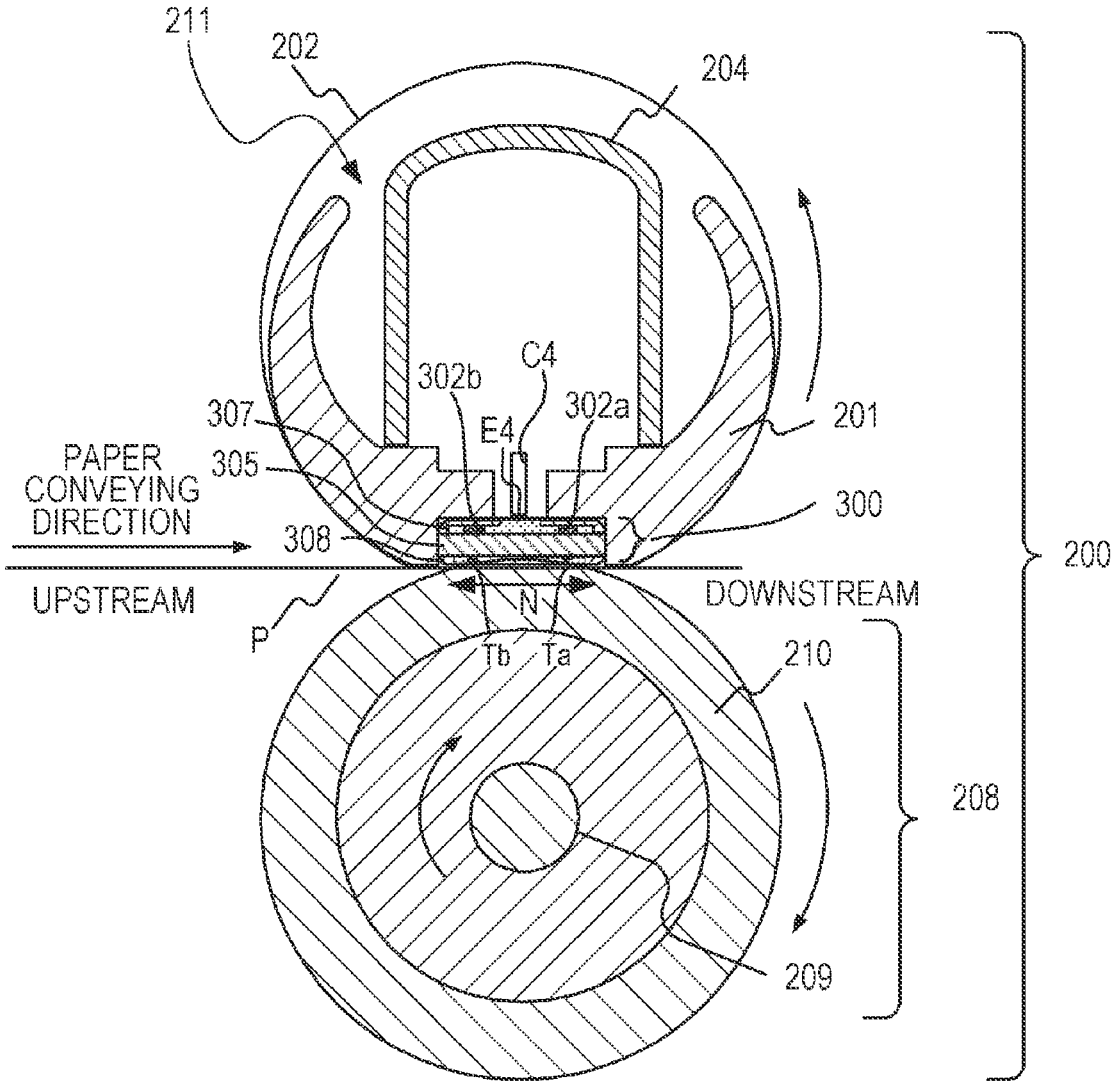
FIG. 2 is a cross sectional view of an image heating apparatus of Embodiment 1.

FIG. 2 is a schematic cross-sectional view of the fixing apparatus 200 as an image heating apparatus of the present Embodiment. The fixing apparatus 200 has a cylindrical film 202 as a heating rotating member (heating member), a heater 300 arranged on the inside of the film 202 as a heat source, a pressure roller 208 as a pressure rotating member (pressure member) in contact with the outer surface of the film 202, and a metal stay 204. The heater 300, a holding member 201 described later, and the metal stay 204 form a heater unit 211. The pressure roller 208 is in pressure contact with the heater 300 via the fixing film 202, and it forms a fixing nip portion N between it and the fixing film 202.

The material for the base layer of the film 202 is a heat-resistant resin such as polyimide, or a metal such as a stainless steel. Further, an elastic layer of heat resistant rubber or the like may be provided at the film 202. A release layer of a fluorine resin or the like may be further provided from thereabove.

The pressure roller 208 has a core metal 209 including a material such as iron or aluminum, and an elastic layer 210 including a material such as silicone rubber. A release layer formed of a tube or coat made of a fluorine resin may be provided from thereabove.

The heater 300 is held by a holding member 201 of a heat resistant resin such as a liquid crystal polymer. The holding member 201 also has a guiding function for guiding the rotation of the film 202.

The pressure roller 208 receives a driving force from a motor 30 and rotates in the direction of an arrow. The film 202 rotates following the rotation of the pressure roller 208. The recording material P bearing an unfixed toner image thereon is heated while being conveyed and interposed at the fixing nip portion N, thereby being subjected to a fixing treatment.

The heater 300 has a substrate 305 made of ceramic described later, and heating resistors (heat generators) 302*a* and 302*b* provided on one surface of the substrate 305, which generate heat by power supply. At the surface (first surface) on the fixing nip portion N side of the other surface opposite to the one surface of the substrate 305, a thermistor Ta as a first temperature detection element and a thermistor Tb as a second temperature detection element for detecting the temperature of the heater are provided. Further, in order to ensure the slidability of the film 202, a surface protective layer 308 made of glass is provided. The second temperature detection elements Tb for detecting a temperature of the first heating block HB4 at a position farther from the recording material conveyance reference position X than the first temperature detection element Ta corresponding to the first heating block HB4 in the longitudinal direction of the heater 300 and a temperature of the second heating block HB3 at a position farther from the recording material conveyance reference position X than the first temperature detection element Ta corresponding to the second heating block HB3 in the longitudinal direction of the heater 300, respectively.

At the surface (second surface) opposite to the fixing nip portion N side surface, a surface protective layer 307 made of glass is provided in order to insulate the heating resistor. At the second surface, an electrode E4 is exposed. An electric power supplying electric contact C4 comes in contact with the electrode, thereby causing the heating resistor to be electrically connected to the control circuit 400. Incidentally, the detailed description of heater 300 will be given later.

The stay 204 made of a metal is for applying a pressure of a spring not shown to the holding member 201, and also has a role of reinforcing the holding member 201 and the heater 300.

(3) Configuration of Heater

FIGS. 3A, 3B, and 3C each show a block view of the heater 300 of Embodiment 1. The image forming apparatus of the present Embodiment is a center-based apparatus for performing convey with the center in the longitudinal direction (the direction orthogonal to the conveying direction) of the recording material aligned with the conveyance reference position X. FIG. 3A is a cross sectional view at the longitudinal central position of the heater 300, and corresponds to the cross section at the reference position X of FIG. 3B. FIG. 3B shows a plan view of the back surface layer of the heater 300, and FIG. 3C shows a plan view of the sliding surface layer of the heater 300.

As shown in FIG. 3A, the heater 300 includes a substrate 305, a back surface layer 1 provided on the substrate 305, a back surface layer 2 covering the back surface layer 1, a sliding surface layer 1 provided on the surface opposite to the back surface layer 1 on the substrate 305, and a sliding surface layer 2 covering the sliding surface layer 1. The heater 300 is arranged so that the longitudinal direction thereof is orthogonal to the conveying direction of the recording material P. The back surface layer 1 of the heater 300 is provided with first conductors 301*a* and 301*b*, and a second conductor 303, and heat generators 302*a* and 302*b* for generating heat by the electric power supplied therethrough on the substrate 305. The first conductors 301*a* and 301*b* are provided along the longitudinal direction of the heater 300 (substrate 305). The conductor 301*b* is arranged on the downstream side in the conveying direction of the recording material P with respect to the conductor 301*a*. The conductor 303 is provided in a manner divided into a plurality of parts along the longitudinal direction of the heater 300 (so as to be aligned in a plurality of parts in the longitudinal direction) between the conductor 301*a* and the conductor 301*b* in the direction orthogonal to the longitudinal direction of the heater 300 (the recording material conveying direction). The heat generator 302*a* is arranged on the downstream side in the conveying direction of the recording material P. The heat generator 302*b* is arranged on the upstream side in the conveying direction. The heat generators 302*a* and the heat generators 302*b* are provided in plurality, respectively, and are arranged so as to be aligned along the longitudinal direction of the heater 300 (substrate 305) (the heat generators 302*a*-1 to 302*a*-7 and the heat generators 302*b*-1 to 302*b*-7). Further, an electrode E4 is provided for electric power supply. Further, on the back surface layer 2, an insulating protective glass 308 covers the region except for the electrode E4.

As shown in FIG. 3B, in the back surface layer 1 of the heater 300, in the direction (longitudinal direction) orthogonal to the conveying direction of the recording material P, a plurality of heating blocks HB individually generating heat are provided. The heater 300 of the present Embodiment has a total of 7 heating blocks HB1 to HB7. Namely, the heat generating segment including the conductor 301, the conductor 303, the heat generator 302*a*, and the heat generator 302*b* is divided into the 7 heating blocks HB1 to HB7 in the longitudinal direction of the heater 300 (substrate 305). In addition, the heating block HB4 is a first heating block and the heating block HB3 is a second heating block. The heat generator 302*a* is divided into 7 regions of heat generators 302*a*-1 to 302*a*-7 in the longitudinal direction of the heater 300. Further, the heat generator 302*b* is divided into 7 regions of heat generators 302*b*-1 to 302*b*-7 in the longitudinal direction of the heater 300. Further, the conductor 303 is divided into 7 regions of conductors 303-1 to 303-7 in alignment with the division positions of the heat generators 302*a* and 302*b*. The back surface layer 1 has electrodes E (E1 to E7, and E8-1 and E8-2). The electrodes E1 to E7 are provided in the regions of the conductors 303-1 to 303-7, respectively, and are electrodes for supplying electric power to the heating blocks HB1 to HB7 via the conductors 303-1 to 303-7, respectively. The electrodes E8-1 and E8-2 are provided so as to be connected to the conductor 301 at the longitudinal end of the heater 300 and are the electrodes for supplying electric power to the heating blocks HB1 to HB7 via the conductor 301. The surface protective glass 308 is formed so as to expose the electrodes E1 to E7, and the electrodes E8-1 and E8-2 of a common electrode among respective heating blocks, and is configured such that an electric contact not shown can be connected from the back surface side of the heater 300. Then, respective heating blocks can be each independently supplied with electric power. Such division into the 7 heating blocks can form 4 paper passing regions as with the AREA1 to AREA4. In the present Embodiment, classification was performed such that AREA1 for A6 width (105 mm), AREA2 for B5 width (182 mm), AREA3 for A4 width (210 mm), and AREA4 for Letter width (216 mm). Incidentally, it is naturally understood that the number of divisions and the division positions of the heating block of the longitudinal division heater are not limited thereto, and they can be arbitrarily changed according to the specifications of the image forming apparatus.

On the sliding surface layer 1 (on the surface opposite to the surface of the substrate 305 on which the heat generator is provided) of the heater 300, thermistors Ta-1 to Ta-7, and thermistors Tb-2, Tb-3, Tb-41, Tb-42, Tb-5, and Tb-6 are set as temperature detection elements for detecting the temperature of each heating block of the heater 300. The thermistors Ta-1 to Ta-7 are mainly used for temperature adjusting control of each heating block, and hence are arranged at the center (the center in the substrate longitudinal direction) of each heating block. Below, for representing the whole temperature controlling thermistors, the thermistors are referred to as thermistor Ta. The thermistors Tb-2, Tb-3, Tb-41, Tb-42, Tb-5, and Tb-6 are end thermistors for detecting the temperature of the non-paper passing region (end) when a recording paper sheet with a smaller width than that of the heat generation region has passed therethrough. For this reason, the thermistors are arranged closer to the outer side of each heating block with respect to the conveyance reference position X except for the heating blocks with a narrow heating region on the opposite ends. The thermistors Tb-4 are arranged as thermistor Tb-41 and thermistor Tb-42 at the opposite ends of the heating block HB4. Below, for representing the whole end thermistors, the thermistors are referred to as Tb.

Further, as shown in FIGS. 3A and 3C, the thermistor Ta to be used for temperature control is arranged at a position on the downstream side in the conveying direction of the recording material P. The end thermistor Tb is arranged on the upstream side thereof. More particularly, the thermistor Ta is arranged at the opposing position (the overlapping position as seen from the direction perpendicular to the surface of the substrate 305) of the heat generator 302*a* on the downstream side provided on the back surface layer 1. Whereas, the end thermistor Tb is arranged at the position opposed to the heat generator 302*b* on the upstream side. The effects regarding the arrangement of the thermistors upstream and downstream of the nip will be described later.

One ends of the thermistors Ta-1 to Ta-7 are connected to conductors ETa-1 to ETa-7 for detecting the resistance value of the thermistor, respectively. In addition, others are connected to the conductor EG9 in common. Whereas, one ends of the thermistors Tb-2, Tb-3, Tb-41, Tb-42, Tb-5, and Tb-6 are connected to the conductors ETb-2, ETb-3, ETb-41, ETb-42, ETb-5, and ETb-6, respectively, and others are connected to the conductor EG10 in common.

The sliding surface layer 2 of the heater 300 has a surface protective layer 308 by coating of glass having slidability. The surface protective layer 308 is provided at the region except for the opposite ends of the heater 300 in order to provide an electric contact to each conductor of the sliding surface layer 1.

Then, independent control of respective heating blocks HB1 to HB7 of the heater 300 will be described. The electric power control of the heater 300 is performed by passing/blocking of a current to the triac (FIG. 12) independently connected to the 7 heating blocks via the electric contacts C1 to C7 in contact with the electrodes E1 to E7 of FIG. 3B. The independent 7 triacs operate in response to a heater driving signal from a CPU in the control portion 400 of the image forming apparatus (FIG. 12), and they can independently control the 7 heating blocks HB1 to HB7.

Figure 12:
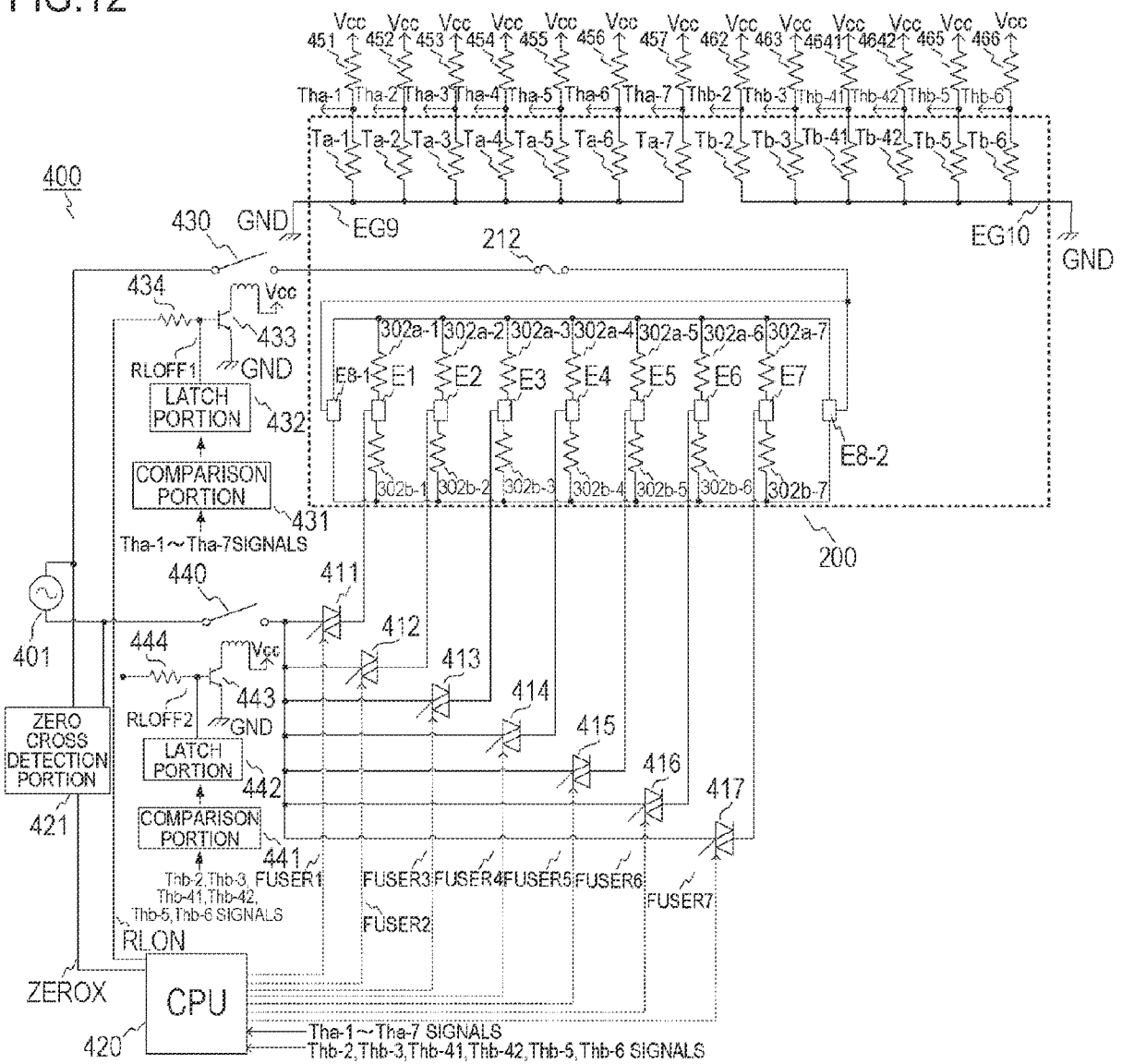
FIG. 12 is a control circuit diagram of the heater of Embodiment 1.

As for the temperature detection circuit of the thermistor, the conductor EG9 and the conductor EG10 are connected to a ground potential. Then, the voltages of all the thermistors Ta-1 to Ta-7, Tb-2, Tb-3, Tb-41, Tb-42, Tb-5, and Tb-6 are each respectively divided by a pull-up resistor (FIG. 12). The divided voltages are detected as Tha-1 to Tha-7 signals, and Thb-2, Thb-3, Thb-41, Thb-42, Thb-5, and Thb-6 signals at the CPU, and are converted from the voltages to the temperatures by the information previously set in the internal memory of the CPU for temperature detection.

(4) Configuration of Heater Control Circuit

FIG. 12 is a circuit diagram of the control circuit 400 of the heater 300 in the present Embodiment. To the image forming apparatus 100, a commercially available AC power supply 401 is connected. The electric power control of the heater 300 is performed by passing/blocking of a current of the triac 411 to triac 417. The triacs 411 to 417 operate in response to FUSER1 to FUSER7 signals from a CPU 420. The driving circuits of the triacs 411 to 417 are not shown.

The control circuit 400 of the heater 300 has a circuit configuration capable of independently controlling the 7 heating blocks HB1 to HB7 by the 7 triacs 411 to 417.

A zero-cross detection portion 421 is a circuit for detecting the zero cross of the AC power supply 401, and outputs a ZEROX signal to the CPU 420. The ZEROX signal is used for detecting the timing for phase control or wave number control of the triacs 411 to 417, or for other purposes.

A description will be given to the temperature detection method of the heater 300. The temperature detection of the heater 300 is performed by the thermistors T (Ta-1 to Ta-7, Tb-2, Tb-3, Tb-41, Tb-42, Tb-5, and Tb-6). The divided voltages between the thermistors Ta-1 to Ta-7, and the resistors 451 to 457 are detected as Tha-1 to Tha-7 signals at the CPU 420, and the Tha-1 to Tha-7 signals are converted into the temperatures at the CPU 420. Similarly, the divided voltages between the thermistors Tb-2, Tb-3, Tb-41, Tb-42, Tb-5, and Tb-6 and the resistors 462, 463, 4641, 4642, 465, and 466 are detected as Thb-2, Thb-3, Thb-41, Thb-42, Thb-5, and Thb-6 signals at the CPU 420, and the Thb-2, Thb-3, Thb-41, Thb-42, Thb-5, and Thb-6 signals are converted into temperatures at the CPU 420.

The CPU calculates the power supply by, for example, PI control based on the set temperature (control target temperature) of each heating block, and the detected temperature of each thermistor. Further, the calculated power supply is converted into the control timing of the corresponding phase angle (phase control), the wave number (wave number control), or the like. The control timing is sent as a heater driving signal, and controls the passing/blocking of a current to the triac. During the fixing treatment, respective heating blocks HB1 to HB7 are controlled so that the detected temperatures of the thermistors Ta-1 to Ta-7 for temperature detection arranged at respective heating blocks are kept at their respective set temperatures (control target temperatures).

A relay 430 and a relay 440 are used as an electric power blocking means to the heater 300 when the heater 300 undergoes an excessive temperature rising due to a failure or the like during a power supply OFF state or during a sleep state.

A description will be given to the circuit operation of the relay 430 and the relay 440. When a RLON signal is put in a High state, a transistor 433 is put in an ON state. Thus, a current is passed from a power supply voltage Vcc to the secondary side coil of the relay 430, so that the primary side contact of the relay 430 is put in an ON state. When the RLON signal is put in a Low state, the transistor 433 is put in an OFF state. Thus, the current flowing from the power supply voltage Vcc to the secondary side coil of the relay 430 is blocked, so that the primary side contact of the relay 430 is put in an OFF state. Similarly, when a RLON signal is put in a High state, the transistor 443 is put in an ON state. Thus, a current is passed from the power supply voltage Vcc to the secondary side coil of the relay 440, so that the primary side contact of the relay 440 is put in an ON state. When a RLON signal is put in a Low state, the transistor 443 is put in an OFF state. Thus, the current flowing from the power supply voltage Vcc to the secondary side coil of the relay 440 is blocked, so that the primary side contact of the relay 440 is put in an OFF state. Incidentally, a resistor 434 and a resistor 444 are each a current limiting resistor.

Then, a description will be given to the operation of the safety circuit using the relay 430 and the relay 440. When any one of the detected temperatures by the thermistors Ta-1 to Ta-7 exceeds each respectively set prescribed value, a comparison portion 431 operates a latch portion 432, and the latch portion 432 latches a RLOFF1 signal in a Low state. When a RLOFF1 signal is put in a Low state, even if the CPU 420 puts a RLON signal into the High state, the transistor 433 is kept in the OFF state. For this reason, the relay 430 can be kept in the OFF state (safe state). Incidentally, the latch portion 432 sets a RLOFF1 signal as an output in the open state in the non-latch state.

Similarly, when any one of the detected temperatures by the thermistors Tb-2, Tb-3, Tb-41, Tb-42, Tb-5, and Tb-6 exceeds each respectively set prescribed value, a comparison portion 441 operates a latch portion 442, and the latch portion 442 latches a RLOFF2 signal in a Low state. When a RLOFF2 signal is put in a Low state, even if the CPU 420 puts a RLON signal into the High state, the transistor 443 is kept in the OFF state. For this reason, the relay 440 can be kept in the OFF state (safe state). Similarly, the latch portion 442 sets a RLOFF2 signal as an output in the open state in the non-latch state.

(5) Effects of Present Embodiment

Figure 4:
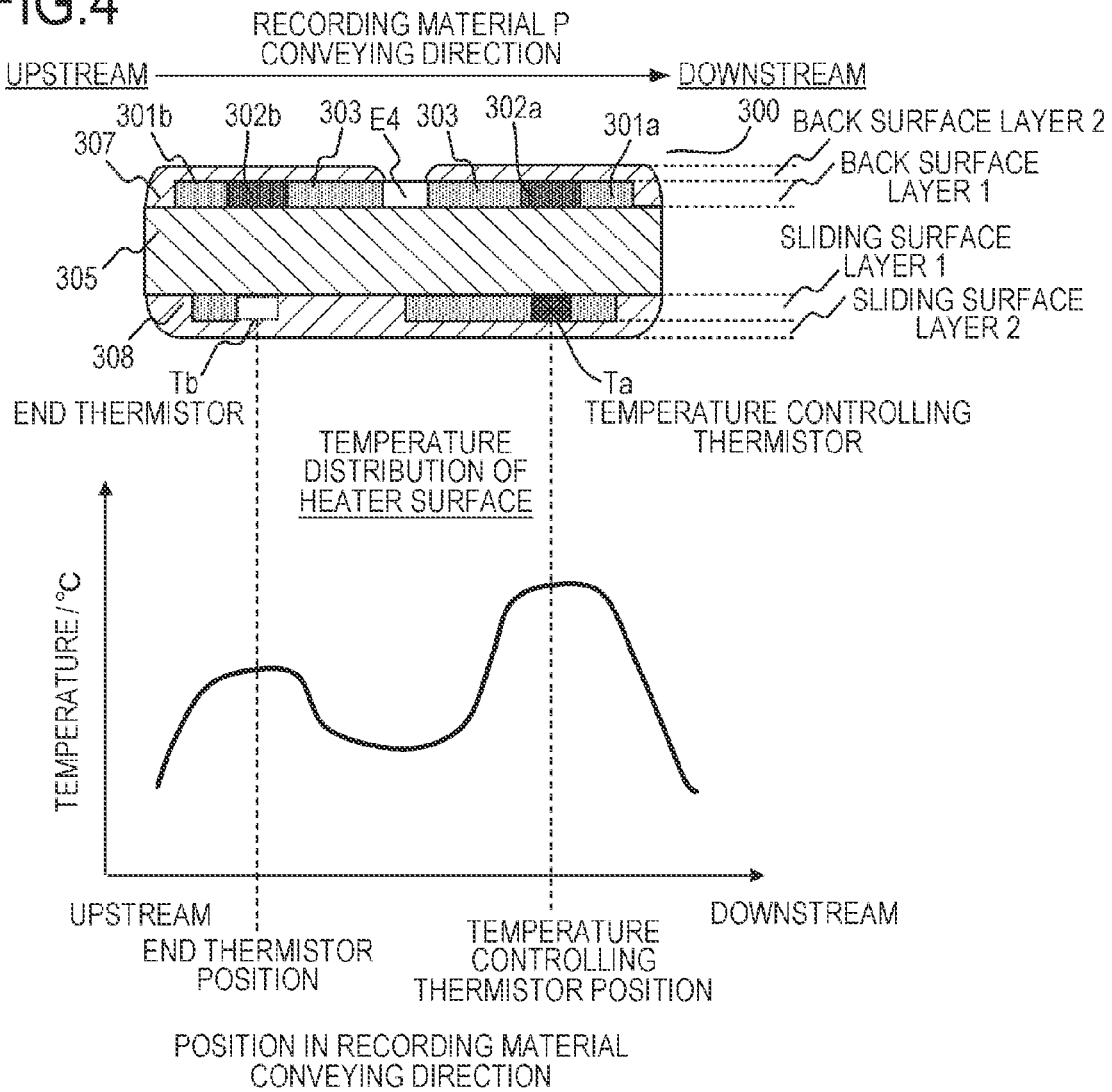
FIG. 4 is a view for illustrating the effects of Embodiment 1.

As described previously, in the present Embodiment, in the conveying direction of the recording material P, a thermistor Ta for temperature control is arranged at a position opposed to the heat generator on the downstream side, and an end thermistor Tb is arranged at a position opposed to the heat generator on the upstream side. FIG. 4 shows the temperature distribution of the heater surface when the fixing apparatus heats the recording material on the cross section in the conveying direction of the heater 300. In the cross sectional view of the heater 300, the position of the end thermistor Tb arranged on the upstream side is also indicated with a dotted line. As apparent from the drawing, during the rotational operation of the fixing apparatus, the temperature of the heater surface is higher on the downstream side than on the upstream side. This is caused due to the following: the temperature of the recording material P introduced to the fixing nip portion during the rotational operation is low, so that the amount of heat transferred to the recording material P is larger on the upstream side. The temperatures of the film and the recording material P passing through the nip portion increase with transfer from the upstream side to the downstream side.

Herein, a consideration will be given to the case where the thermistor Ta for controlling the temperature of each heating block is arranged on the upstream side (the case where all the thermistors including the thermistor Tb are arranged on the upstream side), and the case of the arrangement on the downstream side (the case of the layout of the present Embodiment).

For example, when from the state in which the fixing apparatus stops, an electric power is supplied to the heater, thereby rapidly starting up the heater for control to the target temperature, electric power is controlled so as to prevent the temperature of the heater from exceeding the target temperature. In other words, the temperature of the heater is desirably controlled so as to be prevented from overshooting the target temperature. When the temperature controlling thermistor Ta is provided on the downstream side with a higher temperature, it is easy to perform control while preventing overshooting. However, when the thermistor Ta is arranged on the upstream side with a lower temperature, the temperature on the downstream side cannot be detected. When the difference in temperature between on the upstream side and on the downstream side is always constant, control can be performed by prediction or the like. However, the thickness and the temperature of the recording material to be introduced to the fixing nip portion vary according to the usage pattern of a user and the environment temperature. For this reason, it is difficult to predict the temperature on the downstream side only by the temperature on the upstream side. The heater temperature on the downstream side may overshoot than expected, exceeding the working limit temperature of the heater, or an excessive heat energy may be supplied to the unfixed toner, which may result in the occurrence of an image defect such as hot offset. From the description up to this point, the temperature controlling thermistor Ta is desirably arranged on the downstream side of which the temperature is higher.

Figure 5:
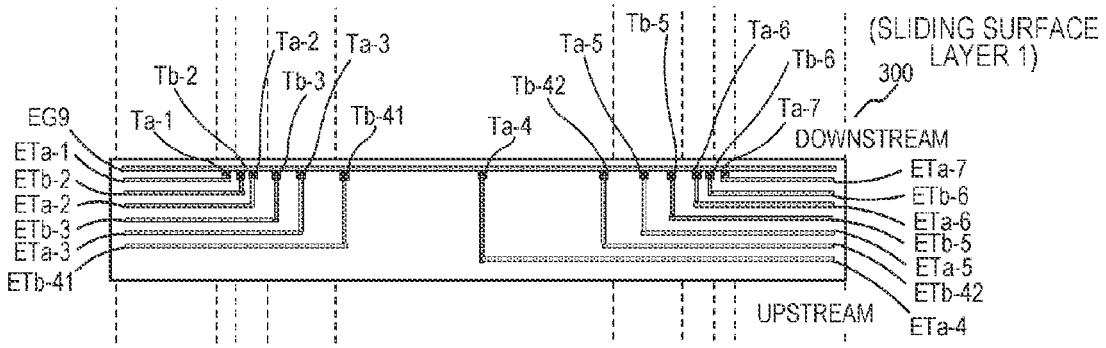
FIG. 5 is a comparative example of Embodiment 1.

On the other hand, an arrangement can also be considered such that all the temperature controlling thermistors Ta and the end thermistors Tb are arranged on the downstream side as shown in FIG. 5. This results in the arrangement on the circuit of the conductor EG9 of the same ground potential. In this case, when a failure such as disconnection is caused in the conductor EG9, the malfunction such as abnormal temperature rising of the heat generator cannot be detected.

Therefore, the temperature controlling thermistors Ta and the end thermistors Tb should be arranged separately on their respective different conductors to be connected with the ground potential. From the description up to this point, the end thermistors Tb are arranged at places other than the downstream position.

Figure 6A:
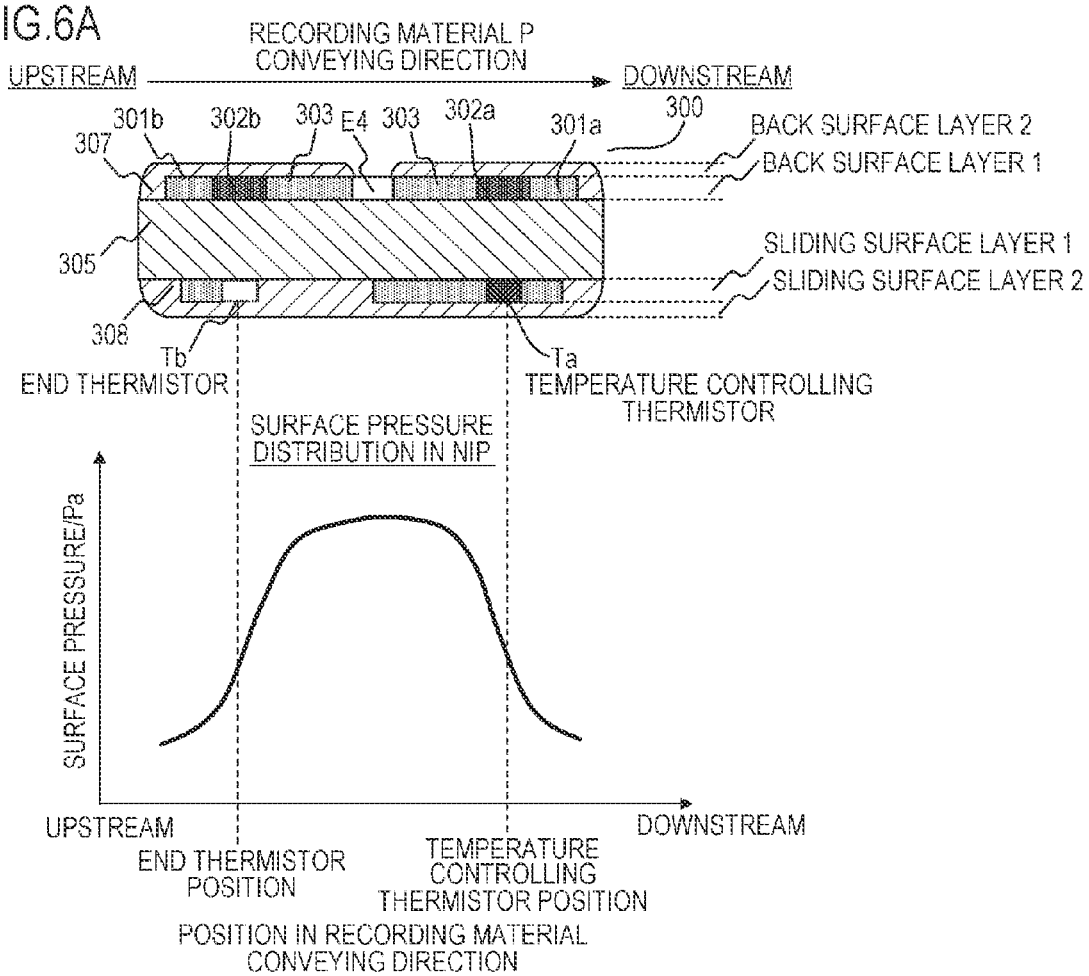
FIGS. 6A and 6B are views for illustrating the effects of Embodiment 1.

In the present Embodiment, the end thermistors Tb were arranged on the upstream side in the conveying direction of the heating nip. The reason why this arrangement is more desirable will be described next. FIG. 6A is a view schematically showing the distribution of the surface pressure in the nip with respect to the cross section in the conveying direction of the heater 300. The surface pressure in the nip has a peak in the vicinity of the center at which the amount of collapse of the elastic layer 210 of the pressure roller 208 is large, and the surface pressure decreases with approach toward the upstream or downstream side in the conveying direction.

Figure 6B:
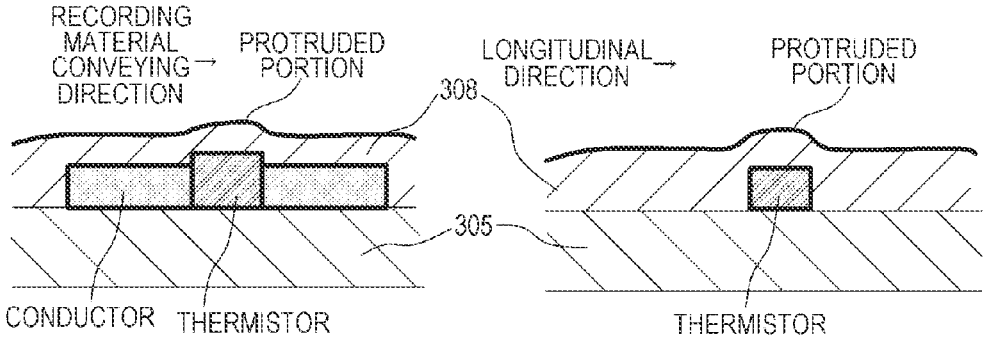
Figure 7:
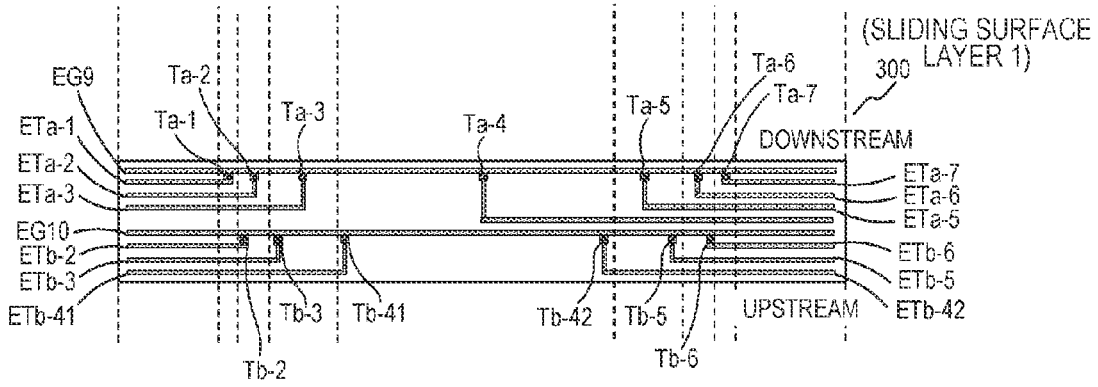
FIG. 7 is an application example of Embodiment 1.

FIG. 6B shows an enlarged view of a configuration of the thermistor portion. The thermistor is formed by applying a thermistor material on the substrate 305 by a method such as screen printing, or other than this, bringing a thermistor element into close contact with the top of the substrate by a method such as adhesion. Further, the thermistor is covered with a thermistor protecting glass 308 as described previously. The portion at which the thermistor is arranged often has a larger thickness than that of the portion at which the thermistor is not arranged, and includes a microscopic protruded portion formed therein as shown in FIG. 6B. Although depending upon the size of the thermistor or the protective glass 308, several-micrometer to several tens-micrometer protruded portion is formed. When such a protruded portion is present at a portion with a high surface pressure in the nip, vertical streaks or gloss unevenness may be given onto the heated and fixed image. As shown in FIG. 6A, the surface pressure of the nip portion has a peak in the vicinity of the nip center. Therefore, when the protruded portion of the thermistor is present at a high surface pressure portion, vertical streaks or gloss unevenness tends to be conspicuous. However, when the protruded portion is arranged at a portion at which the surface pressure of the nip upstream or downstream side is lower, the effects of the pressure decrease. For this reason, the image defect is inhibited. For such a reason, the thermistors are desirably arranged at the upstream and downstream positions with lower surface pressure. However, when the protruded portion does not matter due to the configuration of the thermistor, or in the case of such a heater configuration as not to have a protruded portion formed therein, it does not matter if the end thermistor Tb is arranged in the vicinity of the center as shown in FIG. 7.

Embodiment 1 and Other Application Examples

Figure 8A:
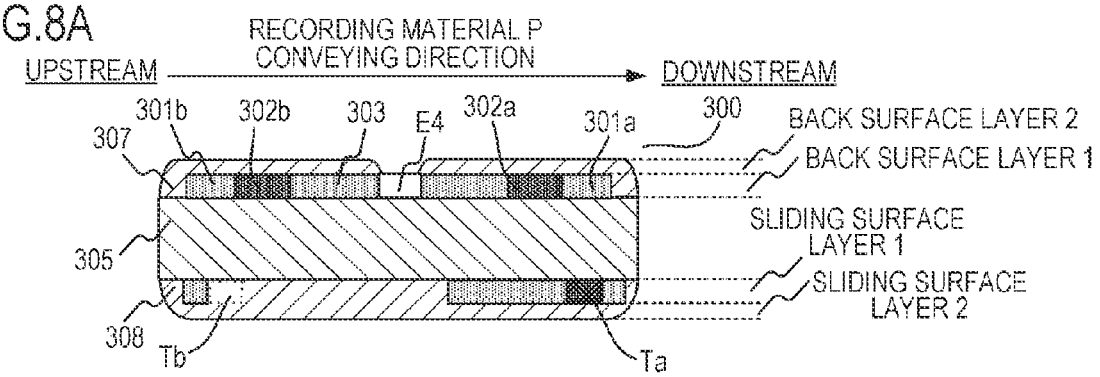
FIGS. 8A and 8B are application examples of Embodiment 1.
Figure 8B:
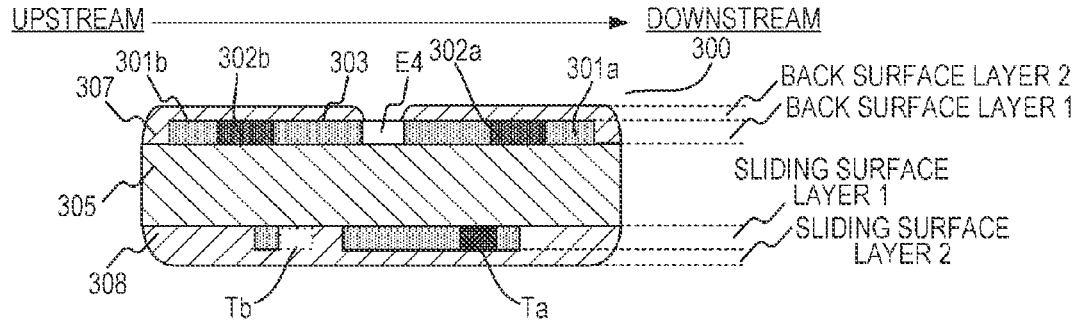

In the foregoing description, in the conveying direction of the recording material P, the temperature controlling thermistor Ta is arranged at a position opposed to the heat generator on the downstream side, and the end thermistor Tb is arranged at a position opposed to the heat generator on the upstream side. However, for example, the following configuration is also possible: as shown in FIG. 8A, both or any one of the dispositions of the upstream and downstream thermistors is arranged on the further outer side of the substrate with respect to the position opposed to the heat generator; or is arranged closer to the substrate center as shown in FIG. 8B. Arrangement on the substrate outer side allows the arrangement at a position with a lower surface pressure when the protruded portion is formed at the sliding surface of the thermistor portion as described in FIGS. 6A and 6B. For this reason, the gloss unevenness or the image defect due to the protruded portion tends to be inhibited.

Further, arrangement on the substrate inner side enables displacement from the peak position of the heater temperature as described in connection with FIG. 4. Although the temperature peak is gentle in FIG. 4, the temperature peak may become steep according to the width or the resistance characteristics of the heat generator 302. When the peak is steep, the difference in detected temperature increases with respect to the positional variations of the thermistor. For this reason, displacement toward the substrate inner side can implement stabilization.

Figure 9:
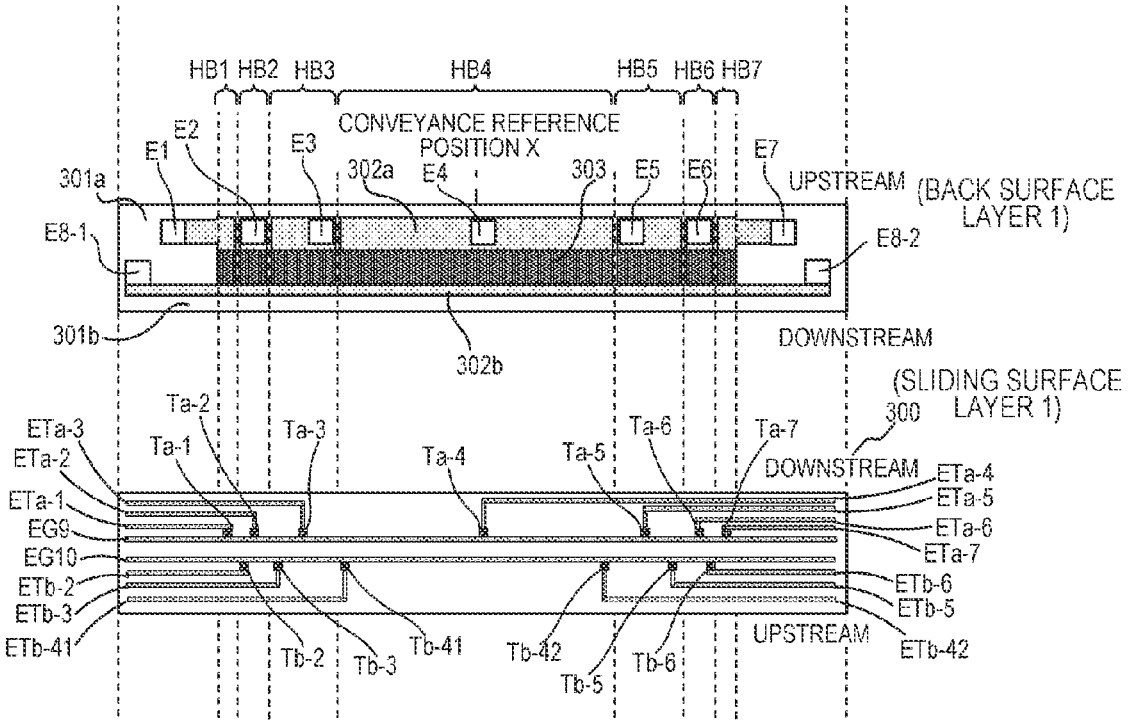
FIG. 9 is an application example of Embodiment 1.

Further, in the present Embodiment, the heater having two heat generators on the upstream and downstream sides was described. For example, even for such a divided heater as to have one heat generator at the center as shown in FIG. 9, a temperature controlling thermistor is arranged on the downstream side of the center, and the end thermistor is arranged on the upstream side of the temperature control thermistor. As a result, the same effects can be obtained.

Embodiment 2

In Embodiment 1, the temperature controlling thermistors Ta are arranged on the downstream side in the conveying direction, and they are arranged on one line in the longitudinal direction. Whereas, the end thermistors Tb are also arranged on the upstream side in the conveying direction, and they are arranged on one line in the longitudinal direction. This is due to the following reason: the temperature distribution in the conveying direction shown in FIG. 4 is substantially uniform at respective heating blocks in the longitudinal direction, and hence arrangement on one line tends to provide longitudinally uniform heat generation distribution even when the temperature control of respective heating blocks is independently performed. However, the positions of the temperature controlling thermistors Ta and the positions of the end thermistors Tb in the longitudinal direction are not necessarily required to be arrayed on one line according to the configuration of the image heating apparatus. For example, as shown in FIG. 10A, the locations of respective thermistors may be arranged so as to be the positions closer to the substrate center side in the recording material conveying direction as the heating block approaches toward the center in the longitudinal direction of the heater (which will be hereinafter referred to as a V-shaped arrangement).

Figure 10A:
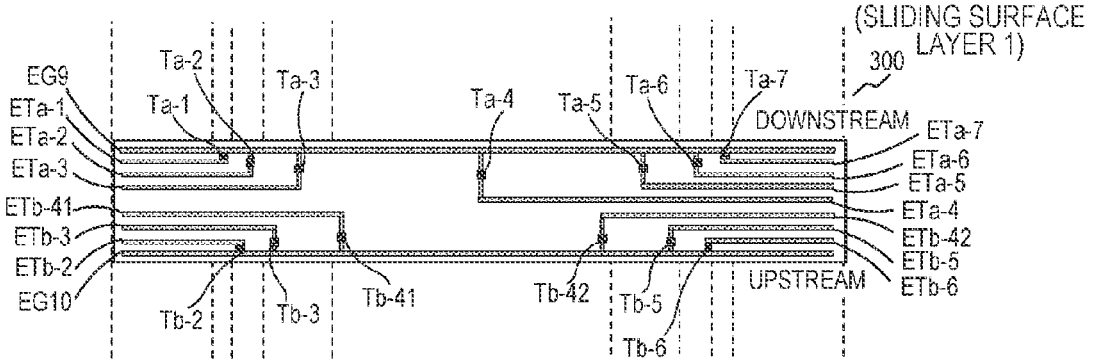
FIGS. 10A and 10B are heater block views of Embodiment 2.
Figure 10B:
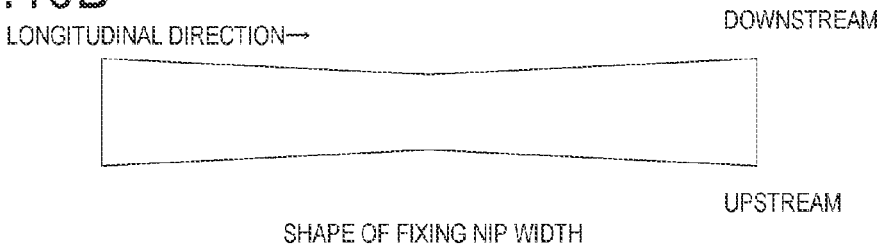

This is applicable to, for example, the case of the configuration such that the fixing nip width in the longitudinal direction is smaller at the longitudinal central portion and becomes remarkably larger at the longitudinal ends than at the central portion as shown in FIG. 10B. For the purpose of more stabilizing the conveyance of the recording material, the conveying capacity of the recording material is larger at the longitudinal end than at the center, so that malfunction such as paper crease can be inhibited. It is necessary to arrange the temperature controlling thermistors Ta and the end thermistor Tb in the fixing nip, and to detect the temperature in the fixing nip with precision.

In the case of the image heating apparatus having the nip shape as described above, in order to arrange respective thermistors in the fixing nip with reliability, the thermistors are desirably arranged in accordance with the nip shape as shown in FIG. 10A. Further, the temperature distribution and the temperature peak on the upstream and downstream sides in the recording material conveying direction may vary in the longitudinal direction. For this reason, the thermistors are desirably arranged at the optimum positions according to the temperature distribution of each heating block. In FIG. 10A, both the temperature controlling thermistors Ta on the downstream side and the end thermistors Tb on the upstream side are arranged in a V shape. However, a configuration is also acceptable in which any one of the thermistors on the upstream and downstream sides is arranged in a V shape, and the other thermistors are arranged on one line.

Figure 11:
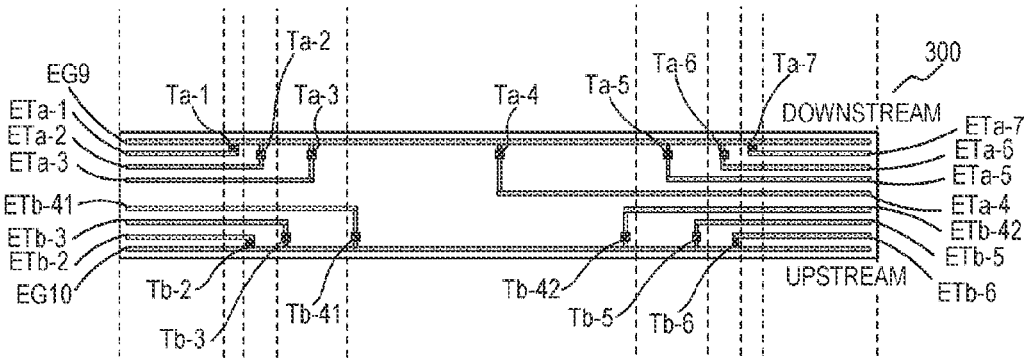
FIG. 11 is an application example of Embodiment 2.

Further, as shown in FIG. 11, the temperature control thermistors Ta or the end thermistors Tb may be arranged not as the V shaped arrangement as in FIGS. 10A and 10B, but as such an arrangement that only the thermistor at longitudinal outermost end is changed in the location in the conveying direction. Further, the arrangement of the temperature control thermistors Ta on the downstream side and the end thermistors Tb on the upstream side is not limited to that of FIG. 10A, FIG. 10B or FIG. 11. Even when the longitudinal heat distribution varies according to the longitudinal shape of the nip width of the heating fixing apparatus, or the member around the heater, the arrangement of individual thermistors can be freely adjusted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-025318, filed on Feb. 18, 2020, which is hereby incorporated by reference herein in its entirety.

What is claimed is:

1. An image heating apparatus for heating an image formed on a recording material, comprising:

a cylindrical film contacting the recording material;

a heater provided in an inner space of the film, the heater including a substrate, a first heating block provided on the substrate, and a second heating block provided on the substrate, wherein the first heating block and the second heating block are arranged along a longitudinal direction of the heater, and the first heating block is independently controlled with respect to the second heating block;

a pressure rotating member forming a nip portion for conveying the recording material between the pressure rotating member and the film;

a first temperature detection element for detecting a temperature of the first heating block; and a second temperature detection element for detecting a temperature of the first heating block at a position farther from a recording material conveyance reference position than the first temperature detection element in the longitudinal direction of the heater, wherein the image heating apparatus heats an image formed on the recording material by using heat of the heater, and wherein the first temperature detection element is arranged on a side downstream of the heater in a recording material conveying direction, and the second temperature detection element is arranged upstream of the first temperature detection element in the recording material conveying direction.

2. An image heating apparatus according to claim 1, wherein the nip portion is formed by sandwiching the film between the heater and the pressure rotating member.

3. A heater for use in heating of an image formed on a recording material to be conveyed by a nip portion formed between a cylindrical film and a pressure rotating member in an image heating apparatus, the heater comprising:

a substrate;

a first heating block provided on the substrate;

a second heating block provided on the substrate, wherein the first heating block and the second heating block are arranged along a longitudinal direction of the heater, and the first heating block is controlled independently with respect to the second heating block;

a first temperature detection element for detecting a temperature of the first heating block; and a second temperature detection element for detecting a temperature of the first heating block at a position farther from a recording material conveyance reference position than the first temperature detection element in the longitudinal direction of the heater, wherein the first temperature detection element is arranged on a side downstream of the heater in a recording material conveying direction, and the second temperature detection element is arranged upstream of the first temperature detection element in the recording material conveying direction.

* * * * *